United States Patent [19]

Clements, Jr.

[11] 4,111,444

[45] Sep. 5, 1978

[54] SKI POLE WITH TIMING DEVICE

[75] Inventor: Joseph A. Clements, Jr., 1217 Littlefield Ave., Northfield, N.J. 08225

[73] Assignee: Joseph A. Clements, Sr., Northfield, N.J.

[21] Appl. No.: 837,721

[22] Filed: Sep. 29, 1977

[51] Int. Cl.[2] ..... A63C 11/22

[52] U.S. Cl. ..... 280/11.37 E; 135/66

[58] Field of Search ..... 280/11.37 E, 11.37 H, 280/11.37 B; 58/152 R, 24, 50 R; 135/66, 65

[56] References Cited

U.S. PATENT DOCUMENTS

| | | | |
|---|---|---|---|
| 3,691,757 | 9/1972 | Merino et al. | 58/152 R X |
| 3,950,935 | 4/1976 | Naito | 58/74 X |
| 3,984,973 | 10/1976 | Ho | 58/50 |
| 4,023,817 | 5/1977 | Lah et al. | 280/11.37 B |

FOREIGN PATENT DOCUMENTS

| | | | |
|---|---|---|---|
| 180,027 | 10/1954 | Austria | 280/11.37 E |
| 2,012,872 | 10/1971 | Fed. Rep. of Germany | 280/11.37 B |

*Primary Examiner*—Joseph F. Peters, Jr.
*Assistant Examiner*—Milton L. Smith
*Attorney, Agent, or Firm*—Bacon & Thomas

[57] ABSTRACT

A ski pole having an accurate timing mechanism associated with the handle portion thereof and including actuation means disposed adjacent the free end of the handle for recording a given period of time and also independently recording split intervals of time within the given period of time. The timing mechanism is preferably an electronic stopwatch having a portable power source and a digital display face that is viewable by the skier from the side of the handle.

12 Claims, 5 Drawing Figures

24.36
88
11.05
28

SKI POLE WITH TIMING DEVICE

BACKGROUND OF THE INVENTION

1. Field of the Invention

The present invention generally relates to apparatus for use in the sport of skiing. Specifically, the invention comprises an improved ski pole having an accurate timing mechanism associated with the handle portion of the pole for easy and positive actuation by the skier in measuring the time it takes to complete a given skiing event.

2. Description of the Prior Art

The sport of skiing can usually be classified into two basic forms, general recreational skiing and competitive skiing.

When skiers are participating in competitive skiing events, such as cross country racing, downhill racing, slalom racing and other similar events, the minimum time within which such an event is completed determines the event winner. Though the timing of such events during actual competition is achieved through accurate and sophisticated timing systems set up and controlled by individuals other than the competitors, there has always existed a need whereby a skier can easily and accurately monitor his own performance, particularly during training sessions.

For example, in training for a slalom race during which a skier must negotiate around and through a plurality of gates, it is extremely advantageous if the skier can conduct his practice sessions over the slalom course while accurately determining, by himself, the time periods required for completion of the course. Such measurements should permit the skier to know just how much time has elapsed since the start of the run and also how much time it takes to complete the distances between any given pair of gates. Accordingly, the skier will be able to conduct all his training sessions in the absence of a separate timekeeper and thereby permit the making, by himself, of necessary adjustments in preparation for the actual race.

In order to realize these advantages, it is highly desirable that a timing mechanism be inconspicuously associated with the handle portion of the ski pole so as to have a minimum effect on the skier's normal usage of the pole. It is further advantageous for such a timing mechanism to be easily actuated and viewed during skiing so as to provide a minimum of visual distraction for the skier.

SUMMARY OF THE INVENTION

It is an object of the present invention to provide an improved ski pole having an accurate timing device associated therewith.

It is another object of the invention to provide an improved ski pole having a timing device capable of accurately and efficiently recording elapsed periods of time during all forms of skiing activities and maneuvers.

It is yet a further object of the present invention to provide a ski pole having a timing mechanism which accurately measures a given period of time required for a skier to complete a specified event and independently recording intervals of time within the given period of time.

The invention serves to achieve the foregoing and other objects by providing a ski pole handle having an accurate timing mechanism associated therewith, with such mechanism being preferably an electronic stopwatch having a digital display face. The timing mechanism may be disposed within a recess provided in the side of the handle so that the display face may be easily viewed by the skier. The mechanism may also be disposed adjacent the base portion of the handle. Actuation buttons provided adjacent the free end of the handle permit manual manipulation of the timing mechanism by the thumb of the skier.

DETAILED DESCRIPTION OF THE PREFERRED EMBODIMENTS

Figures 1, 2, 3, 4, 5:
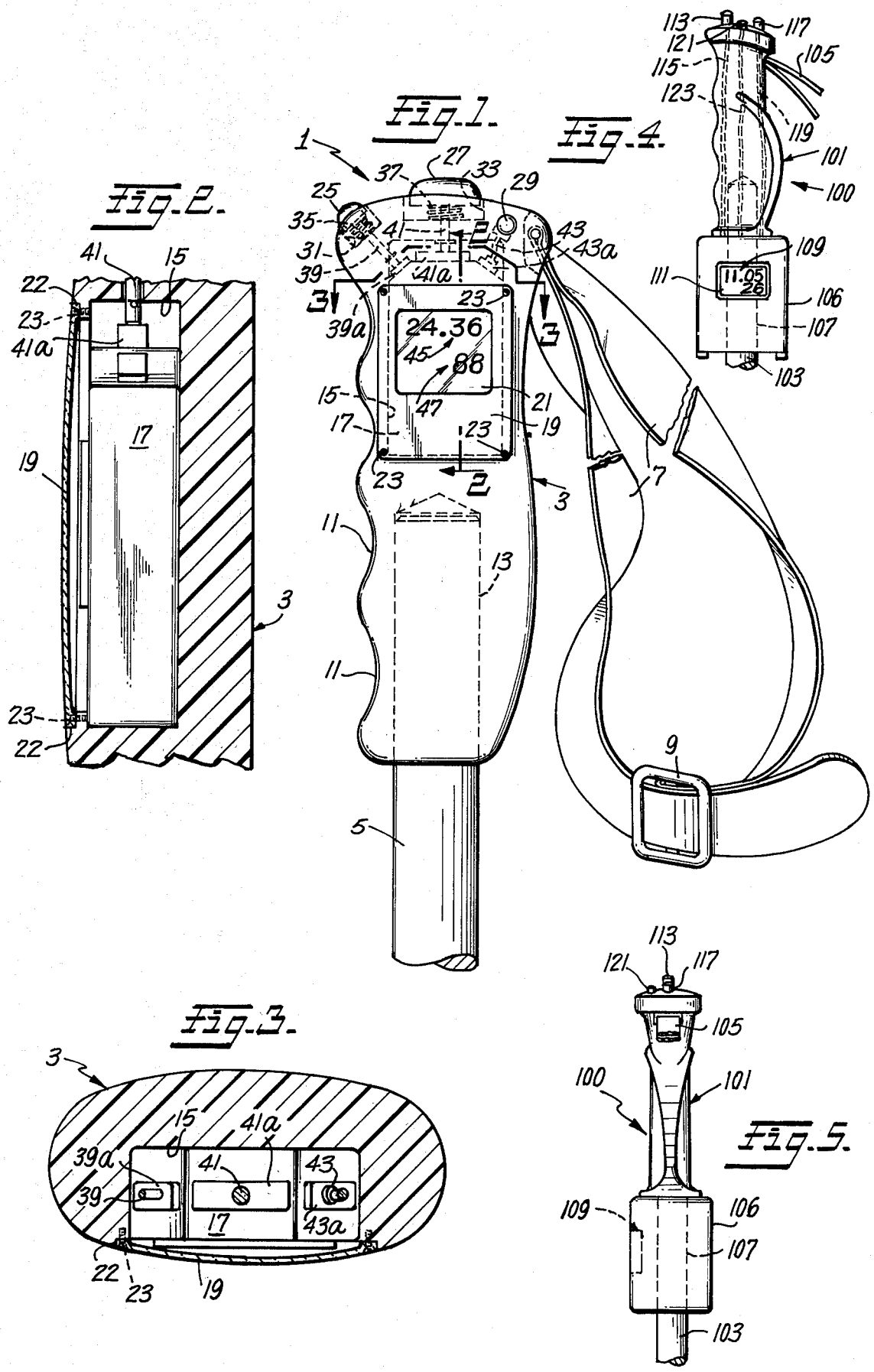
FIG. 1 is a fragmentary side elevational view of the ski pole of the present invention.
FIG. 2 is an enlarged fragmentary vertical sectional view, taken on the line 2—2 of FIG. 1.
FIG. 3 is a horizontal sectional view taken on the line 3—3 of FIG. 1.
FIG. 4 is a fragmentary side elevational view of another embodiment of the invention.
FIG. 5 is a fragmentary rear elevational view of the ski pole depicted in FIG. 4.

The improved ski pole 1 of the invention is depicted in FIG. 1 and includes an elongate-shaped handle 3 and a shaft 5. A wrist strap 7 having an adjusting buckle 9 may be secured to handle 3 by means of a rivet 10 or similar fastening means.

Handle 3 may be made from any suitable material well known in the art for this purpose, though it is preferred that handle 3 be formed as an integral body from moldable plastic or elastomeric material. Handle 3 is provided with a plurality of convolutions 11 integrally formed therewith to provide a gripping surface for the fingers of the skier.

Shaft 5 may be of bamboo, metal, fiberglass or any other well known material found suitable for its intended use and is securely attached to one end of handle 3 as generally indicated at 13. This may be achieved by directly molding handle 3 around the end of shaft 5, by threadedly attaching shaft 5 to handle 3 or by any other secure method of attachment well known in the art. The other end of shaft 5 is provided with the usual basket or ring structure (not shown).

Referring to FIGS. 2 and 3, a recess 15 is provided within the body of handle 3 for receiving a timing device 17 powered by a portable power source (not shown), such as an electric battery. It is preferred that recess 15 be substantially the same size as device 17 in order that a precise fit be achieved for device 17. A transparent cover 19 serves to enclose device 17 within recess 15 and permits viewing of a display face 21 provided on device 17. Cover 19 is received within a peripheral ledge 22 formed around the outer peripheral edge of recess 15 and is secured therein by means of a plurality of screws 23 to permit insertion and removal of device 17 for servicing purposes. As is apparent in FIGS. 2 and 3, the outer surface of cover 19 is substantially coplanar with the corresponding adjacnet portions of handle 3 to thereby provide an overall smooth shape to the exterior configuration of handle 3.

The free end of handle 3 is provided with a first actuation button 25 for resetting timing device 17 back to zero position, a second actuation button 27 for starting and stopping the timing function of device 17 and a third actuation button 29 for independently recording a split interval of time within an overall given period of time being recorded by device 17. Button 25 may alternatively be disposed closer to display face 21 to prevent its accidental actuation.

As seen in FIG. 1, buttons 25 and 27 are partially received in correspondingly shaped recesses 31 and 33 formed in handle 3. A spring 35 is disposed within recess 31 for biasing button 25 in an outward position. Similarly, a spring 37 may be disposed within recess 33 for biasing button 27 in an outward position. Button 29 may also be disposed within a recess and spring-biased in the same manner as buttons 25 and 27.

Button 25 is coupled to a switch 39*a* disposed in device 17 through a direct actuation member 39 for the purpose of resetting the timing device back to a zero position. An actuation member 41 permits button 27 to control a switch 41*a* disposed in device 17 for the purpose of starting and stopping the timing function. Similarly, an actuation member 43 is disposed between button 29 and device 17 for direct actuation of a switch 43*a* contained in device 17 for independently recording split intervals of time within the general time period being measured and recorded through the actuation of button 27.

Device 17 may comprise any accurate timing mechanism which is capable of being structurally utilized in combination with handle 3 in the manner described. It is further desirable that device 17 be capable of the various measuring functions imposed by actuation buttons 25, 27 and 29. Device 17 is preferably an electronically operated stopwatch wherein display face 21 comprises either a liquid crystal display (LCD) or light emitting diode (LED) digital display. As seen in FIG. 1, display face 21 provides a primary indication of total time elapsed in minutes and seconds, as indicated at 45, upon actuation of button 27. Further, a display of a split interval of time in hundredths of a second, as indicated at 47, is provided upon actuation of button 29.

Referring now to FIGS. 4 and 5, there is depicted another embodiment of the invention. A ski pole 100 is shown to include a handle 101 and a shaft 103 embedded within and secured to an end of handle 101. A wrist strap 105 is provided adjacent the free end of handle 101 for securing the hand of the skier therearound.

A housing 106 is carried by shaft 103 adjacent the base of handle 101. A portion of shaft 103, as indicated at 107, passes through housing 106. A timing device having a display face indicated generally at 109, is removably mounted within a recess provided in housing 106 and secured therein by means of a detachable transparent plate 111.

The free end of handle 101 is provided with a first spring-biased actuation button 113 for resetting timing device 109 back to zero position through an actuation member 115. Similarly, a second spring-biased actuation button 117 is provided for starting and stopping the timing function of device 109 through an actuation member 119. A third spring-biased actuation button 121 may also be provided at the free end of handle 101 for independently recording a split interval of time within an overall given period of time in device 109 through an actuation member 123. As indicated in FIG. 4, buttons 113, 117 and 121 are all disposed at the free end of handle 101 with their corresponding actuation members 115, 119 and 123 passing through both handle 101 and the upper portion of housing 106 for direct connection to device 109. Alternatively, button 113 may be disposed on housing 106 to prevent accidental resetting of device 109 back to zero position.

Timing mechanisms which may be utilized in the practice of the invention may include those manufactured and sold by the Heuer Time and Electronics Corporation of Springfield, New Jersey 07081. Specific liquid crystal display models found particularly suitable are the Heuer Microsplit liquid crystal display types designated by REF 370B, REF 370CH and REF 320. However, it is to be understood that any other similar forms of timing mechanisms may also be found equally suitable for use with the present invention.

BASIC MODE OF OPERATION

The operation of the invention shall now be described with reference to the embodiment thereof depicted in FIGS. 1–3. In utilizing the improved ski pole 1, the skier loops strap 7 around his wrist in the usual manner and grips handle 3 by wrapping four fingers around convolutions 11 formed therein. The thumb of the skier is then disposed adjacent buttons 25, 27 and 129. Assume the skier is desirous of timing a slalom run which includes several gates. At the start of the run, button 27 is actuated to thereby begin the recordation of total elapsed time as indicated at 45 on display face 21. As the skier arrives at the first gate and wishes to record the specific interval of time within which it takes him to pass from this gate to the second gate, he presses button 29. This immediately provides a recordation of split time in hundredths of a second as indicated at 47, which recordation is totally independent of the overall elapsed time as shown at 45. By repressing button 29 when the skier has reached the second gate, the total time it took him to travel between the gates will be provided at 47. By again pressing button 29, the time indicated at 47 will be set back to zero position so that the skier may then record the periods of time it takes him to complete the various distances between remaining pairs of gates.

The location of buttons 25, 27 and 29 adjacent the free end of handle 3 permits their individual actuation with a minimum of distraction by utilizing only the thumb of the skier. The disposition of display face 21 on the side of handle 3 permits the skier to quickly determine both overall elapsed times and split interval times when ski pole 1 is held in any position between horizontal and vertical. The overall structural configuration of handle 3 permits the skier to accurately time his efforts during practice or in actual competition with a minimum of distraction. The speed of the skier during any specific run is easily determined by dividing the total elapsed time by the length of the completed course.

It is to be understood that the embodiments of the invention herewith shown and described are to be taken as preferred examples of the same, and that various changes in the shape, size and arrangement of parts and compositions may be resorted to, without departing from the spirit of the invention or scope of the subjoined claims.

I claim:

1. A ski pole comprising:

a. an elongate handle having
   1. a first free end, and
   2. a second end for attachment to a shaft;

b. a recess disposed inwardly of the first free end of the handle;

c. a timing means disposed within the recess and including a display face that is viewable along an axis perpendicular to the longitudinal axis of the handle; and d. means carried adjacent the first free end of the handle for actuating the timing means.

2. The pole of claim 1 wherein the actuating means includes:

a. a first manually-actuated switch for recording a given period of time, and b. a second manually-actuated switch for independently recording a split interval of time within the given period of time.

3. A pole of claim 1 wherein the timing means includes an electronic watch having a digital display face.

4. The pole of claim 3 wherein the display face includes a liquid crystal display.

5. The pole of claim 3 wherein the display face includes light emitting diodes.

6. The pole of claim 1 further including a transparent cover for enclosing the timing device within the recess.

7. The pole of claim 6 wherein the exterior surface of the cover is substantially coplanar with adjacent exterior surface portions of the pole.

8. The pole of claim 1 wherein the actuating means includes a plurality of spring-biased buttons.

9. The pole of claim 1 wherein the handle is molded from plastic material.

10. The pole of claim 1 further including:

a. a wrist strap for securing the pole to the hand of a skier, and b. a plurality of convolutions on the handle for forming a gripping surface.

11. The pole of claim 1 wherein the recess is provided within the handle and between the ends thereof.

12. The pole of claim 1 further including:

a. a housing disposed adjacent the second end of the handle, and b. the recess is provided within the housing.

* * * * *